US010538833B2

(12) United States Patent
Kang et al.

(10) Patent No.: US 10,538,833 B2
(45) Date of Patent: Jan. 21, 2020

(54) ANODIZED-QUALITY ALUMINUM ALLOYS AND RELATED PRODUCTS AND METHODS

(71) Applicant: Novelis Inc., Atlanta, GA (US)

(72) Inventors: Daehoon Kang, Kennesaw, GA (US); Wei Wen, Powder Springs, GA (US); Devesh Mathur, Marietta, GA (US)

(73) Assignee: NOVELIS INC., Atlanta, GA (US)

( * ) Notice: Subject to any disclaimer, the term of this patent is extended or adjusted under 35 U.S.C. 154(b) by 305 days.

(21) Appl. No.: 15/634,199

(22) Filed: Jun. 27, 2017

(65) Prior Publication Data

US 2017/0369978 A1 Dec. 28, 2017

Related U.S. Application Data

(60) Provisional application No. 62/355,527, filed on Jun. 28, 2016.

(51) Int. Cl.

| | |
|---|---|
| ***C22F 1/047*** | (2006.01) |
| ***B21B 1/22*** | (2006.01) |
| ***B22D 7/00*** | (2006.01) |
| ***C22C 21/08*** | (2006.01) |
| ***C25D 11/04*** | (2006.01) |
| ***B21B 3/00*** | (2006.01) |

(52) U.S. Cl.

CPC ..... *C22F 1/047* (2013.01); *B21B 1/22* (2013.01); *B22D 7/005* (2013.01); *C22C 21/08* (2013.01); *C25D 11/04* (2013.01); *B21B 2001/225* (2013.01); *B21B 2003/001* (2013.01)

(58) Field of Classification Search

CPC ..... C22C 21/08; C25D 11/04

See application file for complete search history.

(56) References Cited

U.S. PATENT DOCUMENTS

| | | | | |
|---|---|---|---|---|
| 4,441,933 | A | 4/1984 | Boutin et al. | |
| 2004/0256070 | A1 | 12/2004 | Thompson et al. | |
| 2004/0256079 | A1* | 12/2004 | Akkurt | B22D 11/003 164/480 |
| 2013/0280122 | A1* | 10/2013 | Asano | C25D 11/04 420/532 |
| 2014/0023874 | A1 | 1/2014 | Fukuda et al. | |

FOREIGN PATENT DOCUMENTS

| | | | |
|---|---|---|---|
| JP | 2000160273 | A | 6/2000 |
| JP | 2013-56349 | * | 3/2013 |
| JP | 2015-56349 | * | 3/2013 |
| JP | 2013056349 | A | 3/2017 |
| SU | 1306484 | | 4/1987 |

OTHER PUBLICATIONS

Gaustad, Gabrielle, et al., "Design for Recycling: Evaluation and Efficient Alloy Modification," Journal of Industrial Ecology, Mar. 1, 2010, pp. 286-308, vol. 14, No. 2, Yale University.

International Patent Application No. PCT/US2017/039428, International Search Report and Written Opinion dated Sep. 28, 2017, 13 pages.

International Application No. PCT/US2017/039428 , "International Preliminary Report on Patentability", dated Jan. 10, 2019, 9 pages.

Russian Application No. 2019101046, "Office Action", dated Aug. 9, 2019, 12 pages.

Russian Application No. 2019101046 , "Notice of Decision to Grant", Nov. 5, 2019, 11 pages.

* cited by examiner

*Primary Examiner* — C Melissa Koslow

(74) *Attorney, Agent, or Firm* — Kilpatrick Townsend & Stockton LLP

(57) ABSTRACT

Disclosed are alloys for anodized-quality aluminum sheets with improved surface quality, and methods for making these sheets. The alloys are designed to minimize the formation of cathodic intermetallic particles that result in surface streaks of anodized sheet products formed from the alloys. Further, the alloys allow the incorporation of recycled scrap aluminum in anodized-quality sheets.

13 Claims, 6 Drawing Sheets

ANODIZED-QUALITY ALUMINUM ALLOYS AND RELATED PRODUCTS AND METHODS

CROSS-REFERENCE TO RELATED APPLICATION

This application claims the benefit of U.S. Provisional Application No. 62/355,527, filed Jun. 28, 2016, which is incorporated herein by reference in its entirety.

FIELD

This disclosure relates to the field of anodized aluminum alloy sheets and in particular aluminum alloy sheets which may be anodized for architectural and lithographic applications.

BACKGROUND

Anodized aluminum sheets are used extensively in architectural and lithographic applications. These premium architectural and lithographic products are typically manufactured from very high purity alloys in order to minimize surface defects such as linear streaks. However, the requirement for such high purity alloys severely limits the amount of recycled content that can be incorporated into anodized quality ("AQ") products.

SUMMARY

The present compositions and related products and methods can be utilized to make aluminum 5xxx series sheets for use in a variety of applications, such as architectural and lithographic applications. Such sheets require a very high surface quality. The presence of certain alloying elements and impurities can lead to the appearance of linear streaks on the sheet. Highly pure and expensive alloys have been used to avoid the production of these surface defects. The alloys and methods described herein solve the problems in the prior art and provides alloys and processes that significantly improve surface quality while allowing for incorporation of some recycled content. Specifically, provided herein are anodized-quality aluminum sheets and a process for making anodized-quality aluminum sheets without the need for very high purity alloys found in the prior art. The alloys and methods disclosed herein provide sheets with excellent anodized quality and mechanical properties equivalent to aluminum sheets from high-purity alloys, even when recycled content is incorporated.

Covered embodiments of the invention are defined by the claims, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Compositions for aluminum alloys are described herein. In some examples, an aluminum alloy comprises 0.10-0.30 wt. % Fe, 0.10-0.30 wt. % Si, 0-0.25 wt. % Cr, 2.0-3.0 wt. % Mg, 0.05-0.10 wt. % Mn, 0.02-0.06 wt. % Cu, unavoidable impurities up to 0.05 wt. % for each impurity, up to 0.15 wt. % for total impurities, and the balance aluminum. In certain examples, the aluminum alloy comprises 0.15-0.24 wt. % Fe and 0-0.20 wt. % Cr. In some instances, the aluminum alloy comprises 0.15 wt. % Fe, 0.30 wt. % Si, 2.4 wt. % Mg, 0.07 wt. % Mn, and 0.04 wt. % Cu. In some cases, the ratio of Si:Fe is from 0.2:1 to 2.5:1 or from 0.67:1 to 2.0:1. In some examples, the aluminum alloy comprises between about 1% and about 90% recycled content.

Anodized-quality sheets or anodized sheets may be formed from the aluminum alloys described herein. In some examples, the anodized sheet is architectural quality as measured by visual inspection at a distance of 10 feet by trained personnel. In this inspection, color match between sheets is assessed. In other examples, the anodized sheet is lithographic quality as measured by close-range visual inspection by trained personnel to assess the surface quality. Uniformity, smoothness, glossiness, color, and brightness are evaluated during the visual inspection.

The anodized sheets described herein are high quality, as evidenced by 1) the small size of etch pits and/or the low density of etch pits, and/or 2) the low linearity value (LV) of the sheet and/or an AQ value of less than about 6. In certain examples, the anodized sheet has a density of etch pits of less than about 2000 pits per square millimeter. In some examples, the anodized sheet is free of etch pits having a measurement in any dimension of greater than or equal to 5 μm.

Methods of producing an aluminum sheet are also described herein. In some examples, the method comprises casting an ingot, homogenizing the ingot, hot rolling the homogenized ingot to produce a hot rolled intermediate product, cold rolling the hot rolled intermediate product to produce a cold rolled intermediate product, interannealing the cold rolled intermediate product to produce an interannealed product, cold rolling the interannealed product to produce a cold rolled sheet, and annealing the cold rolled sheet to form an annealed sheet. In some instances, the method further comprises anodizing the annealed sheet.

In some examples, homogenizing comprises two heating steps, wherein the first heating step comprises heating the ingot at about 500-600° C. for about 2-24 hours and the second heating step comprises heating the ingot at about 480° C. for about 8 hours. In some examples, the method further comprises the step of self-annealing the hot rolled intermediate product at about 350° C. for about 1 hour. In some cases, interannealing comprises heating the cold rolled intermediate product at about 355° C. for about 2 hours. In some instances, the cold rolled sheet has a thickness between 1 and 1.5 mm.

In some examples, the method employs an aluminum alloy including 0.10-0.30 wt. % Fe, 0.10-0.30 wt. % Si, 0-0.25 wt. % Cr, 2.0-3.0 wt. % Mg, 0.05-0.10 wt. % Mn, 0.02-0.06 wt. % Cu, unavoidable impurities up to 0.05 wt. % for each impurity, up to 0.15 wt. % for total impurities, and the balance aluminum. In some cases, the aluminum alloy comprises Si and Fe in a ratio of Si:Fe from 0.2:1 to 2.5:1.

Also provided herein are products prepared from the aluminum sheets made according to the method described herein. The product can be a consumer electronic product part, an automobile body part, an architectural part, or a lithographic part.

Other objects and advantages will be apparent from the following detailed description of examples.

DETAILED DESCRIPTION

Figure 1A:
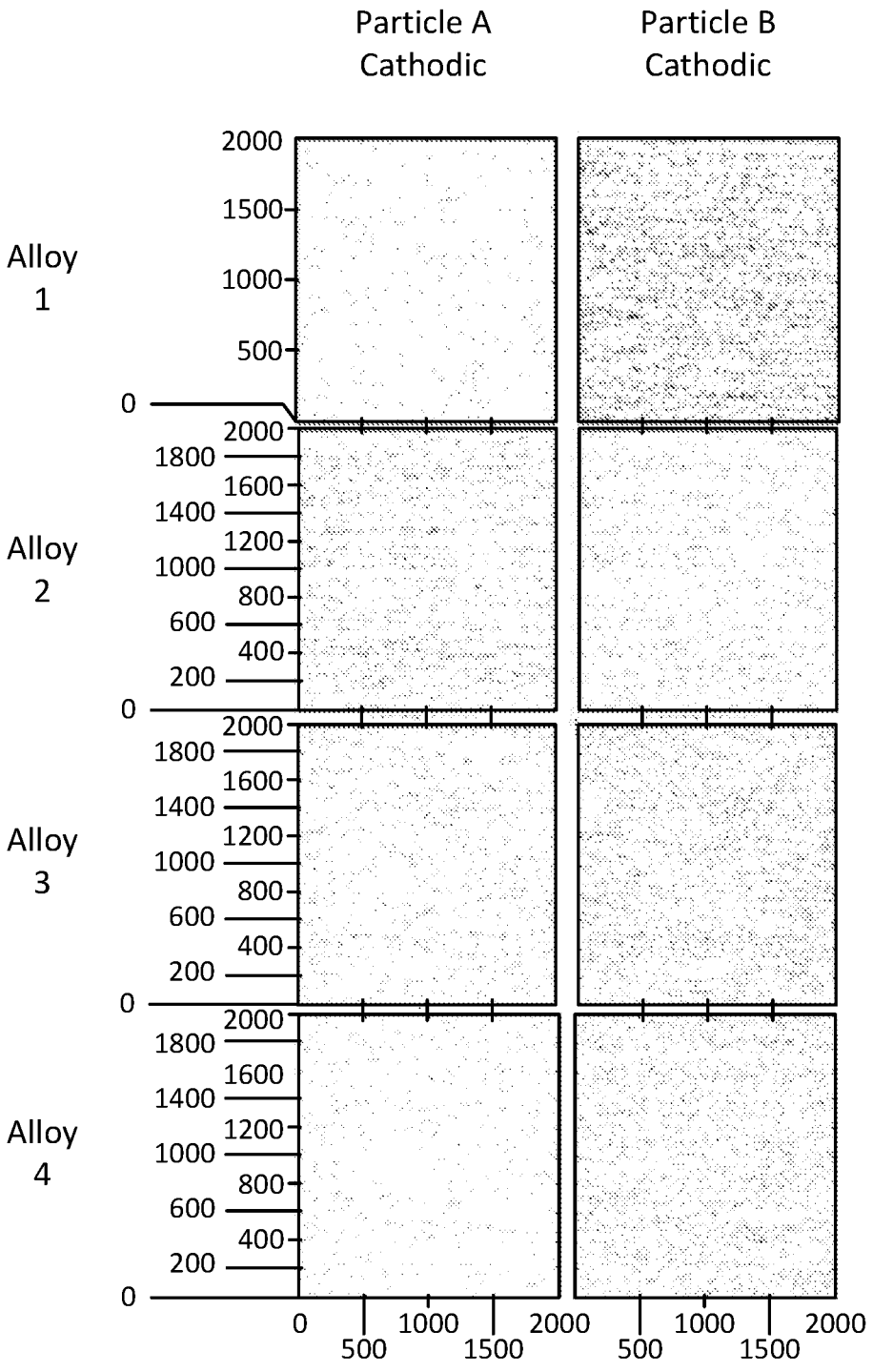
FIGS. 1A and 1B show a spatial distribution map of the types of intermetallic particles in Alloys 1-4 of the disclosure.

Described herein are new aluminum alloy compositions and processes for making high-quality aluminum sheets suitable for anodizing, i.e., anodized-quality aluminum sheets, even when recycled content is included in the alloy. The alloys and processes described herein control the type of intermetallic particles formed and thus provide high-quality aluminum sheets that do not develop unacceptable levels of particle induced linearity, as described in more detail below. As a non-limiting example, the anodized-quality alloys may be 5xxx series aluminum alloys. As another non-limiting example, the sheets made by the processes described herein have particular application in the building industry as architectural sheets.

Definitions and Descriptions

The terms "invention," "the invention," "this invention" and "the present invention" used herein are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "5xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

As used herein, "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

In the following examples, the aluminum alloys are described in terms of their elemental composition in weight percent (wt. %). In each alloy, the remainder is aluminum, with a maximum wt. % of 0.15% for all impurities.

Alloys

The process of refining aluminum is very energy-intensive. Products made from virgin aluminum require much higher energy input than products made from a mixture of virgin aluminum and scrap aluminum. Recycling of aluminum requires far less energy than refining, and it is therefore very desirable for both economic and environmental reasons to include recycled content in aluminum products. However, incorporation of recycled content into certain products may be limited by the impurities and/or alloying elements present in scrap aluminum. Incorporating recycled aluminum content is more difficult in products that have stringent quality requirements. Conventionally, products that require very pure alloys, such as aluminum sheets of sufficient quality for anodization, have incorporated zero to very little recycled content in order to avoid surface defects arising from impurities and/or alloying elements present in the scrap aluminum. This disclosure provides an alloy and process for producing high-quality smooth surface aluminum sheets that may optionally contain recycled content.

Producing anodized-quality premium architectural products requires eliminating fine surface streaks. These streaks result from the presence of linearly distributed intermetallic particles, which may also be called intermetallic stringers. The linear distribution of intermetallic particles along the rolling direction is inevitable in a general sheet making process that uses repeated rolling sequences in one direction, such as a length, as opposed to rolling along two directions, such as cross rolling. The surface quality of an anodized aluminum sheet may be graded by linearity value (LV), where a lower LV corresponds to fewer linear surface streaks or defects.

The intermetallic particles include two or more elements, for example, two or more of aluminum (Al), iron (Fe), manganese (Mn), silicon (Si), copper (Cu), titanium (Ti), zirconium (Zr), chromium (Cr), nickel (Ni), zinc (Zn), and/or magnesium (Mg). Intermetallic particles include, but are not limited to, $Al_x(\underline{Fe},Mn)$, $Al_3Fe$, $Al_{12}(\underline{Fe},Mn)_3Si$, $Al_7Cu_2Fe$, $Al_{20}Cu_2Mn_3$, $Al_3Ti$, $Al_2Cu$, $Al(Fe,Mn)_2Si_3$, $Al_3Zr$, $Al_7Cr$, $Al_x(Mn,Fe)$, $Al_{12}(\underline{Mn},Fe)_3Si$, $Al_3Ni$, $Mg_2Si$, $MgZn_3$, $Mg_2Al_3$, $Al_{32}Zn_{49}$, $Al_2CuMg$, and $Al_6Mn$. When an element in an intermetallic particle is underlined, that element is the dominantly present element in the particle. The notation (Fe,Mn) indicates that the element can be Fe or Mn, or a mixture of the two. While many intermetallic particles contain aluminum, intermetallic particles that do not contain aluminum also exist, such as $Mg_2Si$. The composition and properties of intermetallic particles are described further below.

An alkaline or acidic etching process is employed prior to anodizing the aluminum sheets. During this etching process, linearly distributed intermetallic particles (and/or a portion of the aluminum sheet adjacent to the intermetallic particles) are dissolved or removed from the aluminum sheet, leaving etch pits of various sizes in the aluminum sheet. If the number and/or size of linearly distributed etch pits are excessive, then fine, short streaks become visible on the surface of the aluminum sheet. This phenomenon can be called particle induced linearity. It is desirable to have a low LV, such as an LV of less than 0.050/μm. In order to control the surface topography of the aluminum sheet by minimizing etching, it is necessary to understand the composition of intermetallic particles and their etch response.

Intermetallic particles of aluminum alloys can be categorized into three different types according to their electrochemical potential. The three types are cathodic intermetallic particles, neutral intermetallic particles, and anodic intermetallic particles. Each type shows a different response during alkaline etching. Cathodic particles are more noble than the surrounding aluminum matrix. Therefore, the aluminum matrix adjacent to the particles is preferentially dissolved, leaving relatively larger etch pits around the perimeter of cathodic particles which remain in place during and after the etching process. Large etch pits from cathodic particles result in highly visible streaks which negatively affect the anodized quality of a material. On the other hand, anodic particles are dissolved more easily than the aluminum matrix surrounding them, leaving etch pits the same size as the anodic particles. As the etch pits left from anodic particles are smaller than those left from cathodic particles, the presence of anodic particles is less harmful to the anodized quality of the sheet than is the presence of cathodic particles. Finally, electrochemically neutral particles are dissolved at almost the same rate as the surrounding aluminum matrix, thus forming minimal etch pits. Etch pits remain after the anodizing step, but the etch pits created by neutral and anodic particles are much smaller and less visible than etch pits created by cathodic particles. Therefore, neutral and anodic particles are less harmful than cathodic particles to the anodized quality of the sheet.

One goal is to classify and control the type of intermetallic particles present in an alloy to be the most favorable in terms of electrochemical potential for minimizing etch pits. Not intending to be bound by theory, when the formation of cathodic particles is minimized, the size and number density of etch pits decreases, resulting in improved anodized quality of the aluminum sheet with less particle induced linearity. This improvement may be observed even when the overall number of intermetallic particles remains the same, as long as the percent cathodic particles formed is reduced.

Table 1 details intermetallic particles and their electrochemical potential in 0.01-0.1M NaCl at pH 6 in comparison to the aluminum matrix. Intermetallic particles with an oxidation potential that is positive compared to the aluminum matrix (greater than ~50 millivolts (mV)) are cathodic, and the aluminum matrix surrounding this type of particle will dissolve during an alkaline etch process before the cathodic particles will dissolve. Intermetallic particles with an oxidation potential that is about the same as the aluminum matrix (~−50 mV to ~−50 mV) are neutral, and the aluminum matrix surrounding this type of particle will dissolve during an alkaline etch process at about the same rate as the neutral particles. Intermetallic particles with negative oxidation potentials are anodic and will dissolve before the surrounding aluminum matrix dissolves. Table 1 lists common intermetallic particles by particle type, and in some cases lists their oxidation potentials. The notation (Fe,Mn) indicates that the element can be Fe or Mn, or a mixture of the two. When either the Fe or the Mn is underlined, the underlined element is the dominantly present element of those two elements. Oxidation potential is listed in parentheses where known. As Table 1 shows, Fe, Mn, Cu, and Ti are the elements that lead to the formation of cathodic particles. Thus, it is essential to minimize these elements in the alloys.

TABLE 1

| Cathodic Particles Preferred dissolution of matrix adjacent to particle | Neutral Particles Similar reactivity to matrix | Anodic Particles Preferred dissolution of intermetallics |
|---|---|---|
| $Al_x(\underline{Fe},Mn)$, $Al_3Fe$ (+186~284 mV) | $Al_3Zr$ (−73~+47 mV) | $Mg_2Si$ (−715 mV) |
| $Al_{12}(\underline{Fe},Mn)_3Si$ | $Al_7Cr$ | $MgZn_3$ (−206 mV) |
| $Al_7Cu_2Fe$ (+130~272 mV) | $Al_x(\underline{Mn},Fe)$ | $Mg_2Al_3$ (−190 mV) |
| $Al_{20}Cu_2Mn_3$ (+129~258 mV) | $Al_{12}(\underline{Mn},Fe)_3Si$ (−211~+13 mV) | $Al_{32}Zn_{49}$(−181 mV) |
| $Al_2Ti$ (+220 mV) | $Al_3Ni$ | $Al_2CuMg$ (−277~−60 mV) |
| $Al_2Cu$ (+50~158 mV) | | $Al_6Mn$ (−160~+44 mV) |
| $Al(Fe,Mn)_2Si_3$ | | |

Aluminum alloy compositions that minimize the presence of cathodic intermetallic particles are desired. One such aluminum alloy comprises about 0.10-0.30 wt. % Fe, 0.10-0.30 wt. % Si, 0-0.25 wt. % Cr, 2.0-3.0 wt. % Mg, 0.05-0.10 wt. % Mn, 0.02-0.06 wt. % Cu, unavoidable impurities up to 0.05 wt. % for each impurity, up to 0.15 wt. % for total impurities, and the balance aluminum. In some instances, this alloy may comprise 0.15-0.24 wt. % Fe, and 0-0.20 wt. % Cr. In other instances, this alloy may comprise 0.15 wt. % Fe, 0.30 wt. % Si, 2.4 wt. % Mg, 0.07 wt. % Mn, and 0.04 wt. % Cu.

In some examples, the alloy comprises about 0.05 wt. %, 0.10 wt. %, 0.15 wt. %, 0.20 wt. %, 0.25 wt. %, 0.30 wt. %, 0.40 wt. %, or 0.50 wt. % Fe, or 0.05-0.35 wt. %, 0.10-0.25 wt. %, 0.15-0.30 wt. %, or 0.15-0.25 wt. % Fe. In some examples, the alloy comprises about 0.05 wt. %, 0.10 wt. %, 0.15 wt. %, 0.20 wt. %, 0.25 wt. %, 0.30 wt. %, 0.35 wt. %, 0.40 wt. %, 0.45 wt. %, or 0.50 wt. % Si, or 0.05-0.35 wt. %, 0.10-0.25 wt. %, 0.15-0.30 wt. %, or 0.15-0.25 wt. % Si. In some examples, the alloy comprises about 0.05 wt. %, 0.10 wt. %, 0.15 wt. %, 0.20 wt. %, 0.25 wt. %, or 0.30 wt. % Cr, or 0-0.20 wt. %, 0-0.10 wt. %, 0-0.05 wt. %, 0-0.25 wt. %, 0.05-0.20 wt. %, 0.10-0.20 wt. %, or 0.05 to 0.15 wt. % Cr. In some examples, the alloy comprises about 2.0 wt. %, 2.25 wt. %, 2.5 wt. %, 2.75 wt. %, or 3.0 wt. % Mg, or 2.0-2.5 wt. %, 2.5-3.0 wt. %, or 2.25-2.75 wt. % Mg. In some examples, the alloy comprises about 0.06 wt. %, 0.07 wt. %, 0.08 wt. %, 0.09 wt. %, or 0.10 wt. % Mn, or 0.06-0.10 wt. %, 0.07-0.10 wt. % Mn. In some examples, the alloy comprises about 0.02 wt. %, 0.03 wt. %, 0.04 wt. %, 0.05 wt. %, or 0.06 wt. % Cu, or 0.02-0.04 wt. %, 0.04-0.06 wt. %, or 0.03-0.05 wt. % Cu.

In addition, changing the Si:Fe ratio changes the dominant phase type. For example, raising the Si:Fe ratio minimizes the formation of cathodic type particles in a 5xxx series aluminum alloy. Similarly, controlling the ratios of elements in other alloys, such as 3xxx series aluminum alloys and 4xxx series aluminum alloys, to minimize the formation of cathodic type particles will also improve the quality of those anodized sheets. In some examples, the aluminum alloy has a ratio of Si:Fe from 0.2:1 to 2.5:1. In some examples, the ratio of Si:Fe is from 0.67:1 to 2.0:1. In some examples, the ratio of Si:Fe is 2.0:1, wherein the Fe content of the alloy is no greater than 0.15 wt. %.

In some examples, the sheet has a cathodic particle density of no more than 120 particles per square millimeter, no more than 200 particles per square millimeter, no more than 300 particles per square millimeter, no more than 400 particles per square millimeter, no more than 500 particles per square millimeter, no more than 1000 particles per square millimeter, no more than 1500 particles per square millimeter, or no more than 2000 particles per square millimeter.

In some examples, the aluminum alloy comprises between about 1% and about 90% recycled content (e.g., between about 1% and about 50%, about 50% and about 90%, about 10% and about 80%, about 20% and about 60%, about 1% and about 40%, about 1% and about 30%, about 1% and about 20%, or about 1% and about 10% recycled content). In some examples, the aluminum alloy includes 1%, 5%, 10%, 15%, 20%, 25%, 30%, 35%, 40%, 45%, 50%, 55%, 60%, 65%, 70%, 75%, 80%, 85%, or 90% recycled content. As mentioned above, it is desirable for economic and for environmental reasons to include recycled aluminum content in aluminum products. For the purposes of this disclosure, "recycled content" may refer to manufacturing waste or post-consumer waste products (collectively: scrap aluminum). The identity and concentration of alloying elements or impurities varies depending on the source of the scrap aluminum. For example, beverage cans are a common source of scrap aluminum. An AA3004 aluminum alloy is commonly used for beverage can bodies, but an AA5182 alloy is used for the ends and tabs. AA3004 includes nominal 1.2% Mn and 1% Mg. AA5182 includes nominal 5% Mg, 0.5% Mn, and 0.1% Cr.

Anodized Sheets

The alloys may be formed into aluminum sheets by any method known to those of ordinary skill in the art. Further, the aluminum sheets may be etched in an acid or base bath, and then anodized. In some examples, an anodized sheet includes an aluminum alloy including 0.10-0.30 wt. % Fe, 0.10-0.30 wt. % Si, 0-0.25 wt. % Cr, 2.0-3.0 wt. % Mg, 0.05-0.10 wt. % Mn, 0.02-0.06 wt. % Cu, unavoidable impurities up to 0.05 wt. % for each impurity, up to 0.15 wt. % for total impurities, and the balance aluminum. In certain examples, the aluminum alloy comprises 0.15-0.24 wt. % Fe and 0-0.20 wt. % Cr. In some instances, the aluminum alloy comprises 0.15 wt. % Fe, 0.30 wt. % Si, 2.4 wt. % Mg, 0.07 wt. % Mn, and 0.04 wt. % Cu. In some cases, the ratio of Si:Fe is from 0.2:1 to 2.5:1 or from 0.67:1 to 2.0:1. In some examples, the aluminum alloy comprises between about 1% and about 90% recycled content (e.g., between about 1% and about 50%, about 50% and about 90%, about 10% and about 80%, about 20% and about 60%, about 1% and about 40%, about 1% and about 30%, about 1% and about 20%, or about 1% and about 10% recycled content). In some examples, the aluminum alloy includes 1%, 5%, 10%, 15%, 20%, 25%, 30%, 35%, 40%, 45%, 50%, 55%, 60%, 65%, 70%, 75%, 80%, 85%, or 90% recycled content. In some examples, the presence of cathodic intermetallic particles that include $Al_x(FeMn)$, $Al_3Fe$, $Al_{12}(Fe,Mn)_3Si$, and $Al(Fe,Mn)_2Si_3$ is lower than for conventional 5xxx series aluminum alloys.

In some examples, the anodized sheet is of architectural quality, as measured by visual inspection. Color match and rough streakiness should be at or below acceptable limits when observed at a 10 foot distance. In some examples, the anodized sheet is of lithographic quality as measured by visual inspection. Fine streakiness and pick-ups should be at or below acceptable limits when observed at a 10 foot distance.

In some examples, the sheet has an AQ value of less than 8, less than 7, less than 6, less than 5, or less than 4, as measured by AQ visual grading. Lower AQ values indicate higher AQ quality (e.g., a sheet having an AQ value of 1 indicates that the sheet has a higher anodized quality than a sheet having an AQ value of 10).

As described above, controlling the nature of intermetallic particles to minimize the presence of cathodic particles results in aluminum sheets with high surface quality. The quality of the surface can be assessed visually, because etch pits are visible to the naked eye as linear streaks. In some examples, the anodized sheet has a density of etch pits of less than about 3000 pits, less than about 2000 pit, less than about 1500 pits, less than about 1000 pits, or less than about 500 pits per square millimeter (mm). Further, these etch pits must be limited in size for high surface quality. In some examples, the anodized sheet is substantially free of etch pits having a width of greater than about 2 μm and/or length of greater than about 10 μm. As used herein, the term substantially free, as related to the number of etch pits having a certain dimension (e.g., a width and/or a length) means that the percentage of etch pits having the certain dimension is less than 0.1%, less than 0.01%, less than 0.001%, or less than 0.0001% based on the total number of etch pits. In some cases, the anodized sheet is substantially free of etch pits having a measurement in any dimension of greater than 0.25 μm, 0.5 μm, 0.75 μm, 1 μm, 1.25 μm, 1.5 μm, 1.75 μm, 2 μm, 3 μm, 4 μm, 5 μm, 6 μm, 7 μm, 8 μm, 9 μm, or 10 μm.

Methods of Making

The methods disclosed herein are efficient methods to make anodized-quality 5xxx sheets with desired mechanical and physical properties. Suitable alloys for making the sheets described herein include any alloy within the AA5xxx designation, as established by The Aluminum Association. Non-limiting exemplary AA5xxx series alloys can include AA5182, AA5183, AA5005, AA5005A, AA5205, AA5305, AA5505, AA5605, AA5006, AA5106, AA5010, AA5110, AA5110A, AA5210, AA5310, AA5016, AA5017, AA5018, AA5018A, AA5019, AA5019A, AA5119, AA5119A, AA5021, AA5022, AA5023, AA5024, AA5026, AA5027, AA5028, AA5040, AA5140, AA5041, AA5042, AA5043, AA5049, AA5149, AA5249, AA5349, AA5449, AA5449A, AA5050, AA5050A, AA5050C, AA5150, AA5051, AA5051A, AA5151, AA5251, AA5251A, AA5351, AA5451, AA5052, AA5252, AA5352, AA5154, AA5154A, AA5154B, AA5154C, AA5254, AA5354, AA5454, AA5554, AA5654, AA5654A, AA5754, AA5854, AA5954, AA5056, AA5356, AA5356A, AA5456, AA5456A, AA5456B, AA5556, AA5556A, AA5556B, AA5556C, AA5257, AA5457, AA5557, AA5657, AA5058, AA5059, AA5070, AA5180, AA5180A, AA5082, AA5182, AA5083, AA5183, AA5183A, AA5283, AA5283A, AA5283B, AA5383, AA5483, AA5086, AA5186, AA5087, AA5187, and AA5088. In some examples, alloys described herein may be used for making the sheets.

The alloys described herein can be cast into ingots using a Direct Chill (DC) process. The resulting ingots can optionally be scalped. The ingot can then be subjected to further processing steps. In some examples, the processing steps include a two-stage homogenization step, a hot rolling step, a cold rolling step, an optional interannealing step, a cold rolling step, and a final annealing step.

The homogenization step described herein can be a single homogenization step or a two-step homogenization process. The first homogenization step dissolves metastable phases into the matrix and minimizes microstructural inhomogeneity. An ingot is heated to attain a peak metal temperature of at least about 560° C. (e.g., at least about 550° C., at least about 555° C., at least about 565° C., or at least about 570° C.) during a heating time of 2-24 hours, 2-5 hours, 5-12 hours, 12-18 hours, or 18-24 hours, or at least 2 hours, at least 12 hours, or at least 24 hours. In some examples, the ingot is heated to attain a peak metal temperature ranging from about 560° C. to about 575° C. The heating rate to reach the peak metal temperature can be from about 50° C. per hour to about 100° C. per hour. For example, the heating rate can be about 50° C. per hour, about 55° C. per hour, about 60° C. per hour, about 65° C. per hour, about 70° C. per hour, about 75° C. per hour, about 80° C. per hour, about 85° C. per hour, about 90° C. per hour, about 95° C. per hour, or about 100° C. per hour. The ingot is then allowed to soak (i.e., maintained at the indicated temperature) for a period of time during the first homogenization stage. In some examples, the ingot is allowed to soak for up to six hours (e.g., from 30 minutes to six hours, inclusively). For example, the ingot can be soaked at a temperature of about 560° C. for five hours.

In the second homogenization step, the ingot temperature is decreased to a temperature of from about 450° C. to 540° C. prior to subsequent processing. In some examples, the ingot temperature is decreased to a temperature of from about 480° C. to 540° C. prior to subsequent processing. For example, in the second stage, the ingot can be cooled to a temperature of about 470° C., about 480° C., about 500° C., about 520° C., or about 540° C. and allowed to soak for a period of time. In some examples, the ingot is allowed to soak at the indicated temperature for up to 8 hours (e.g., from 30 minutes to eight hours, inclusively, such as 30 minutes, 1 hour, 2 hours, 3 hours, 4 hours, 5 hours, 6 hours, 7 hours, or 8 hours). For example, the ingot can be soaked at the temperature of about 480° C. for 8 hours.

Following the second homogenization step, a hot rolling step can be performed. The hot rolling step can include a hot reversing mill operation and/or a hot tandem mill operation. The hot rolling step can be performed at a temperature ranging from about 250° C. to about 450° C. (e.g., from about 300° C. to about 400° C. or from about 350° C. to about 400° C.). In the hot rolling step, the ingot can be hot rolled to a thickness of 10 mm gauge or less (e.g., from 3 mm to 8 mm gauge). For example, the ingots can be hot rolled to a 8 mm gauge or less, 7 mm gauge or less, 6 mm gauge or less, 5 mm gauge or less, 4 mm gauge or less, or 3 mm gauge or less. Optionally, the hot rolling step can be performed for a period of up to one hour. Optionally, at the end of the hot rolling step (e.g., upon exit from the tandem mill), the sheet is coiled.

The hot rolled sheet can then undergo a cold rolling step. The sheet temperature can be reduced to a temperature ranging from about 20° C. to about 200° C. (e.g., from about 120° C. to about 200° C.). The cold rolling step can be performed for a period of time to result in a final gauge thickness of from about 1.0 mm to about 3 mm, or about 2.3 mm. Optionally, the cold rolling step can be performed for a period of up to about 1 hour (e.g., from about 10 minutes to about 30 minutes).

The cold rolled coil can then undergo an interannealing step. The interannealing step can include heating the coil to a peak metal temperature of from about 300° C. to about 400° C. (e.g., about 300° C., 305° C., 310° C., 315° C., 320° C., 325° C., 330° C., 335° C., 340° C., 345° C., 350° C., 355° C., 360° C., 365° C., 370° C., 375° C., 380° C., 385° C., 390° C., 395° C., or 400° C.). The heating rate for the interannealing step can be from about 20° C. per minute to about 100° C. per minute. The interannealing step can be performed for a period of 2 hours or less (e.g., 1 hour or less). For example, the interannealing step can be performed for a period of from 30 minutes to 50 minutes.

The interannealing step may be followed by another cold rolling step. The cold rolling step can be performed for a period of time to result in a final gauge thickness between about 0.5 mm and about 2 mm, between about 0.75 and 1.75 mm, between about 1 and 1.5 mm, or about 1.27 mm. Optionally, the cold rolling step can be performed for a period of up to about 1 hour (e.g., from about 10 minutes to about 30 minutes).

The cold rolled coil can then undergo an annealing step. The annealing step can include heating the coil to a peak metal temperature of from about 180° C. to about 350° C. (e.g., about 175° C., about 180° C., about 185° C., about 200° C., about 225° C., about 250° C., about 275° C., about 300° C., about 325° C., about 350° C., about 355° C., or about 360° C.). The heating rate for the annealing step can be from about 10° C. per hour to about 100° C. per hour. The annealing step can be performed for a period of up to 48 hours or less (e.g., 1 hour or less). For example, the annealing step can be performed for a period of from 30 minutes to 50 minutes.

The alloys, anodized sheets, and methods described herein can be used in several applications, including architectural applications, lithographic applications, electronics applications, and automotive applications. Architectural AQ sheets are widely used for flashing, window sills, door panels, curtain walls, and decorative panels, as non-limiting examples. During the anodizing process, the oxidized surface of the aluminum may be colored with a pigment or dye, providing a wide range of color and style for interior design. In some examples, the sheets can be used to prepare products, such as consumer electronic products or consumer electronic product parts. Exemplary consumer electronic products include mobile phones, audio devices, video devices, cameras, laptop computers, desktop computers, tablet computers, televisions, displays, household appliances, video playback and recording devices, and the like. Exemplary consumer electronic product parts include outer housings (e.g., facades) and inner pieces for the consumer electronic products. In some examples, the sheets and methods described herein can be used to prepare automobile body parts, such as inner panels. In some examples, a product prepared from the alloys described herein may be a consumer electronic product part, an automobile body part, an architectural part, or a lithographic part.

The following examples will serve to further illustrate the disclosed examples without, at the same time, however, constituting any limitation thereof. On the contrary, it is to be clearly understood that resort may be had to various examples, modifications, and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

EXAMPLES

Example 1: Anodizing-Quality Sheet Preparation

The ingots used to prepare anodized-quality sheets were cast using DC casting from alloys having the composition shown in Table 2 and scalped using methods known to those of skill in the art. All elements are expressed in wt. % based on the total weight of the alloy, with the balance Al.

TABLE 2

| Alloy | Fe | Si | Cr | Mg | Mn | Cu |
|---|---|---|---|---|---|---|
| 1 | 0.24 | 0.18 | 0.20 | 2.40 | 0.07 | 0.04 |
| 2 | 0.15 | 0.10 | — | 2.40 | 0.07 | 0.04 |

TABLE 2-continued

| Alloy | Fe | Si | Cr | Mg | Mn | Cu |
|---|---|---|---|---|---|---|
| 3 | 0.15 | 0.10 | 0.10 | 2.40 | 0.07 | 0.04 |
| 4 | 0.15 | 0.30 | — | 2.40 | 0.07 | 0.04 |

Each of alloys 1-4 was processed by the following method. The ingot was cast and scalped to a 3" (inch) gauge, and then was heated from room temperature to 560° C. and allowed to soak for approximately six hours. The ingot was then cooled to 480° C. and allowed to soak for approximately eight hours. The resulting ingot was then hot rolled to a 7 mm thick gauge. The resulting sheet self-annealed at a temperature of 350° C. for about one hour. The sheet was then cold rolled to a 2.3 mm thick gauge. The cold rolled sheet was then interannealed at a temperature of 335° C. for about two hours, and then cold rolled again to a 1.27 mm thick gauge. The resulting sheet was annealed at 225° C. for about two hours.

Example 2: Sheet Property Testing

Figure 1B:
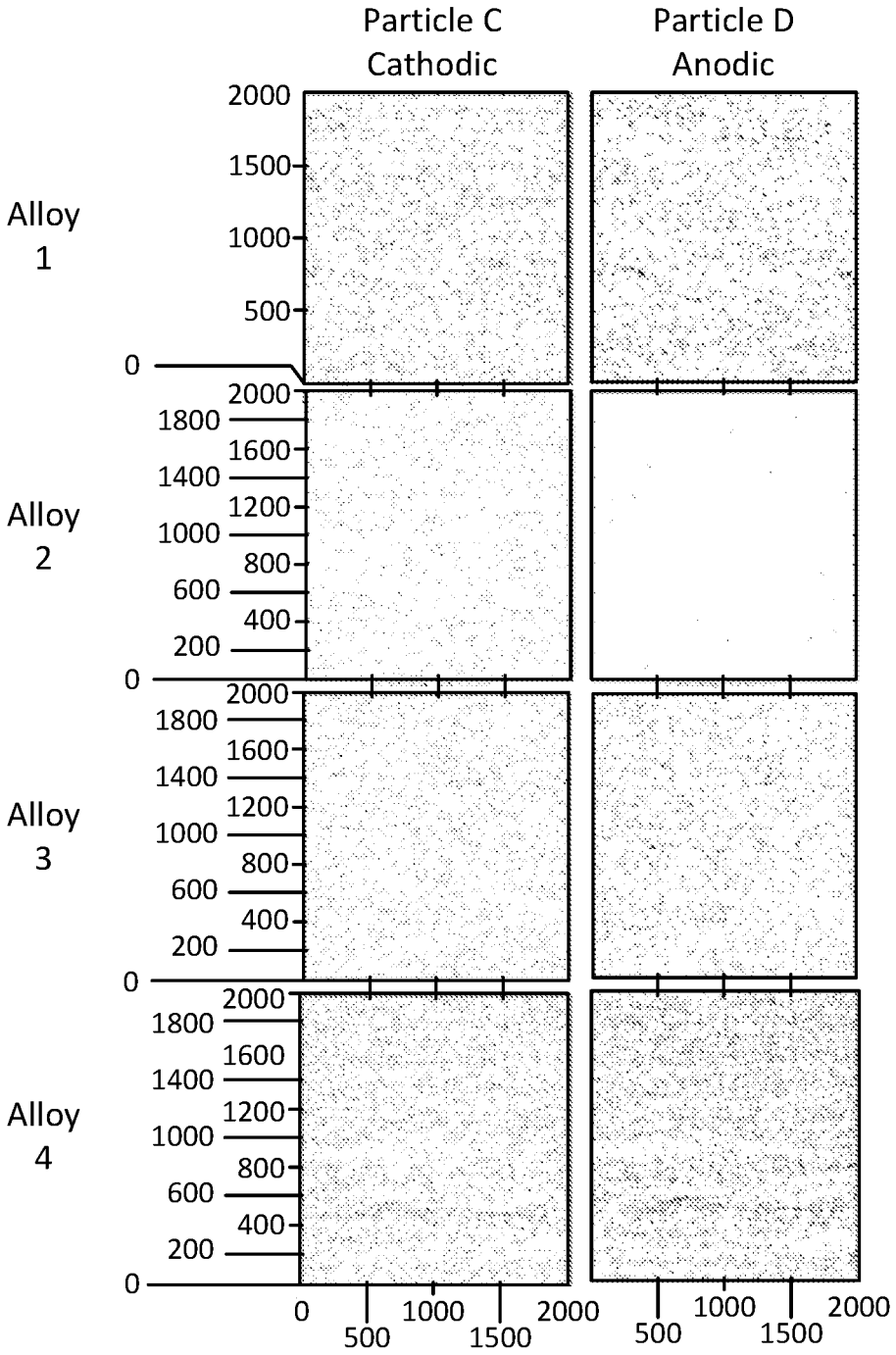

Sheets 1-4 prepared from Alloys 1-4 according to Example 1 were evaluated to produce a spatial distribution map of intermetallic particles A-D, as shown in FIGS. 1A and 1B.

Figure 2A:
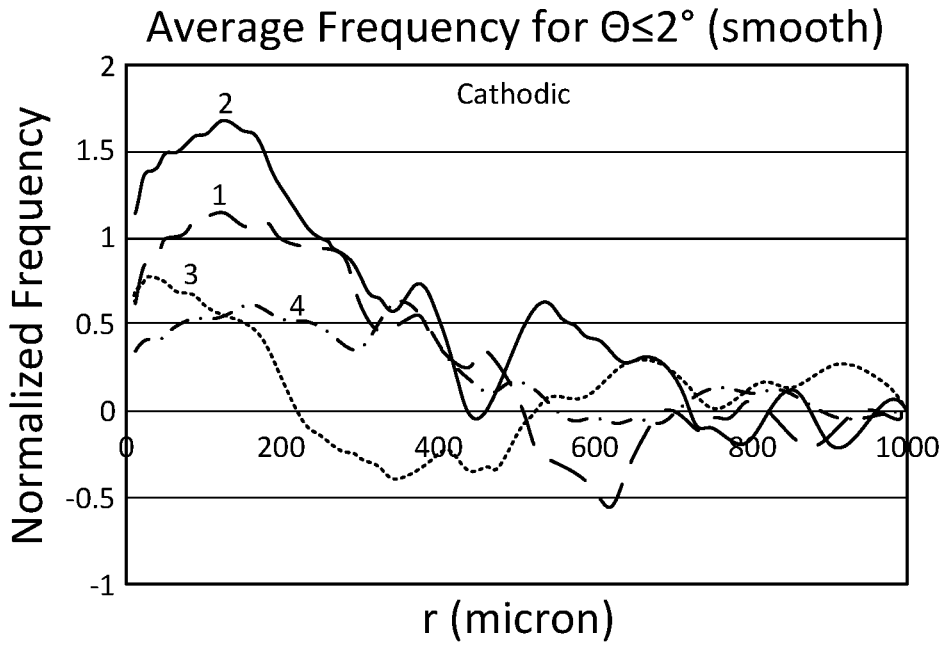
FIG. 2A shows a calculated particle distribution linearity of overall cathodic particles in Alloys 1-4 of the disclosure.
Figure 2B:
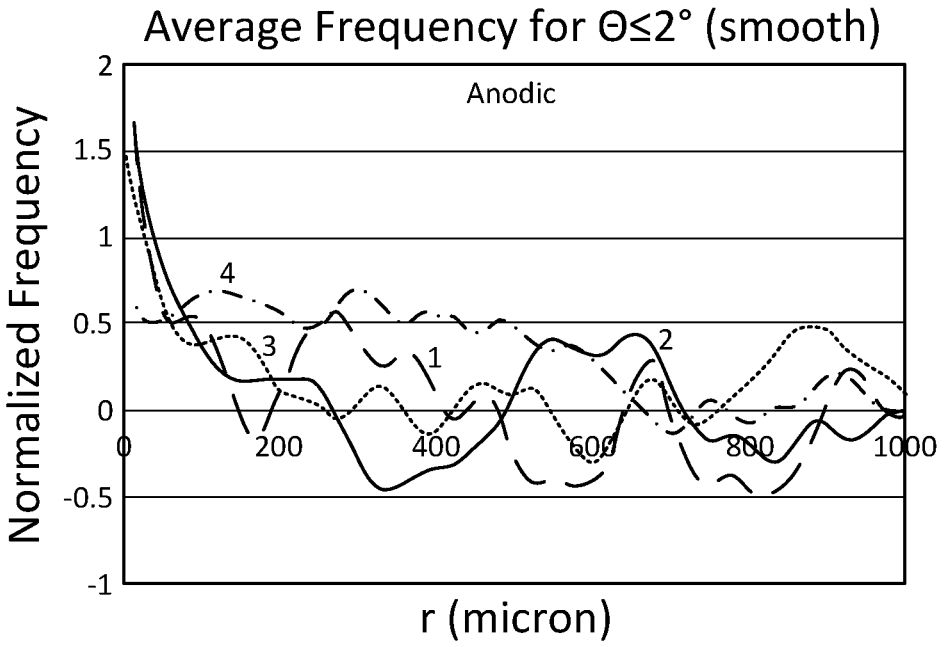
FIG. 2B shows a calculated particle distribution linearity of overall anodic particles in Alloys 1-4 of the disclosure.

Data from the FIG. 1A and FIG. 1B spatial distribution maps were used to calculate the particle distribution linearity of cathodic particles (shown in FIG. 2A) and anodic particles (shown in FIG. 2B). Alloys 1 and 2 show a higher linear distribution of cathodic particles than Alloys 3 and 4, with Alloy 4 having the lowest linear distribution of cathodic particles. Therefore, Alloy 4 is expected to have the best surface quality after etching.

Figure 3A:
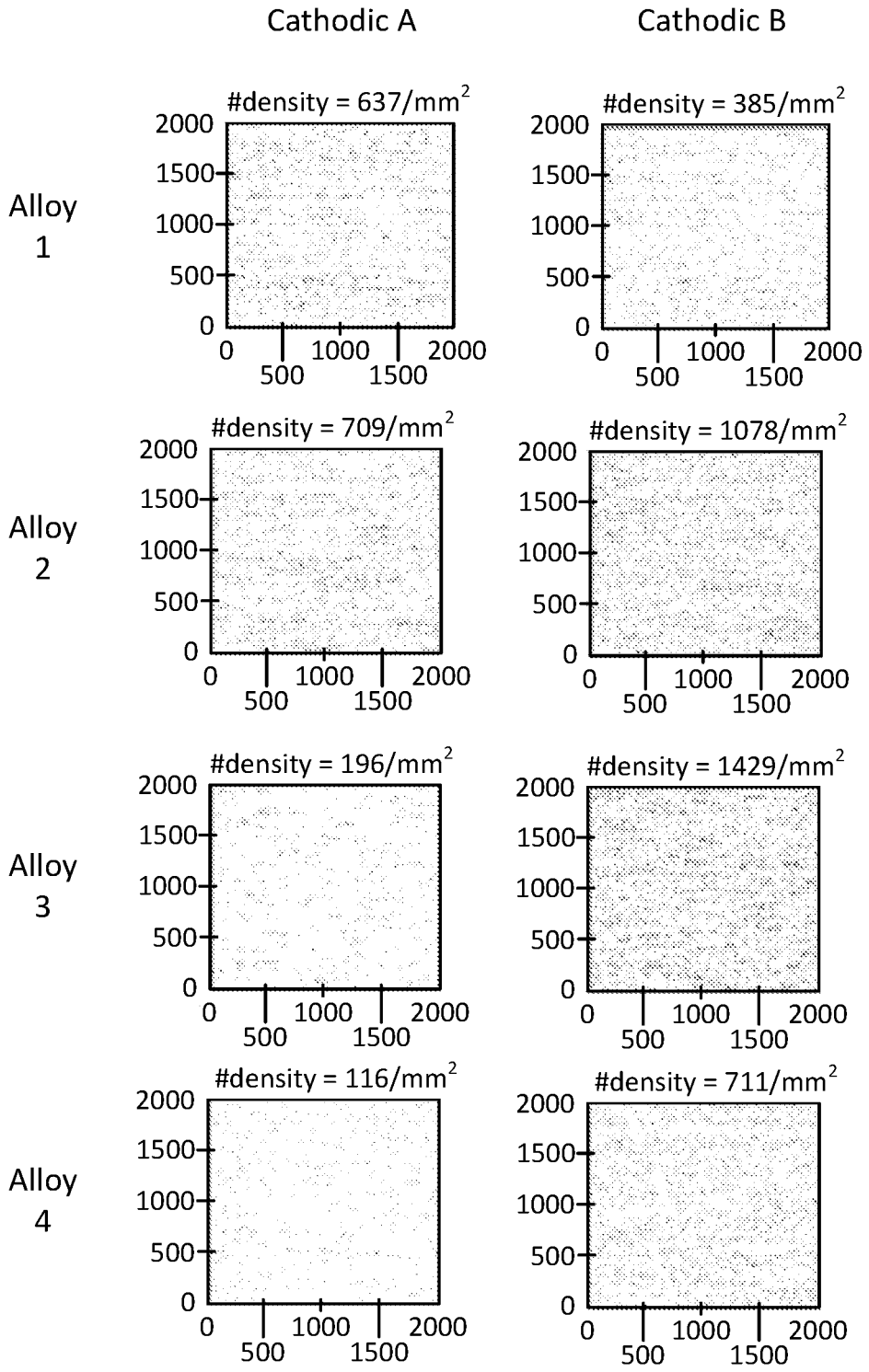
FIGS. 3A and 3B show a spatial distribution map of four main intermetallic particles in Alloys 1-4 of the disclosure.
Figure 3B:
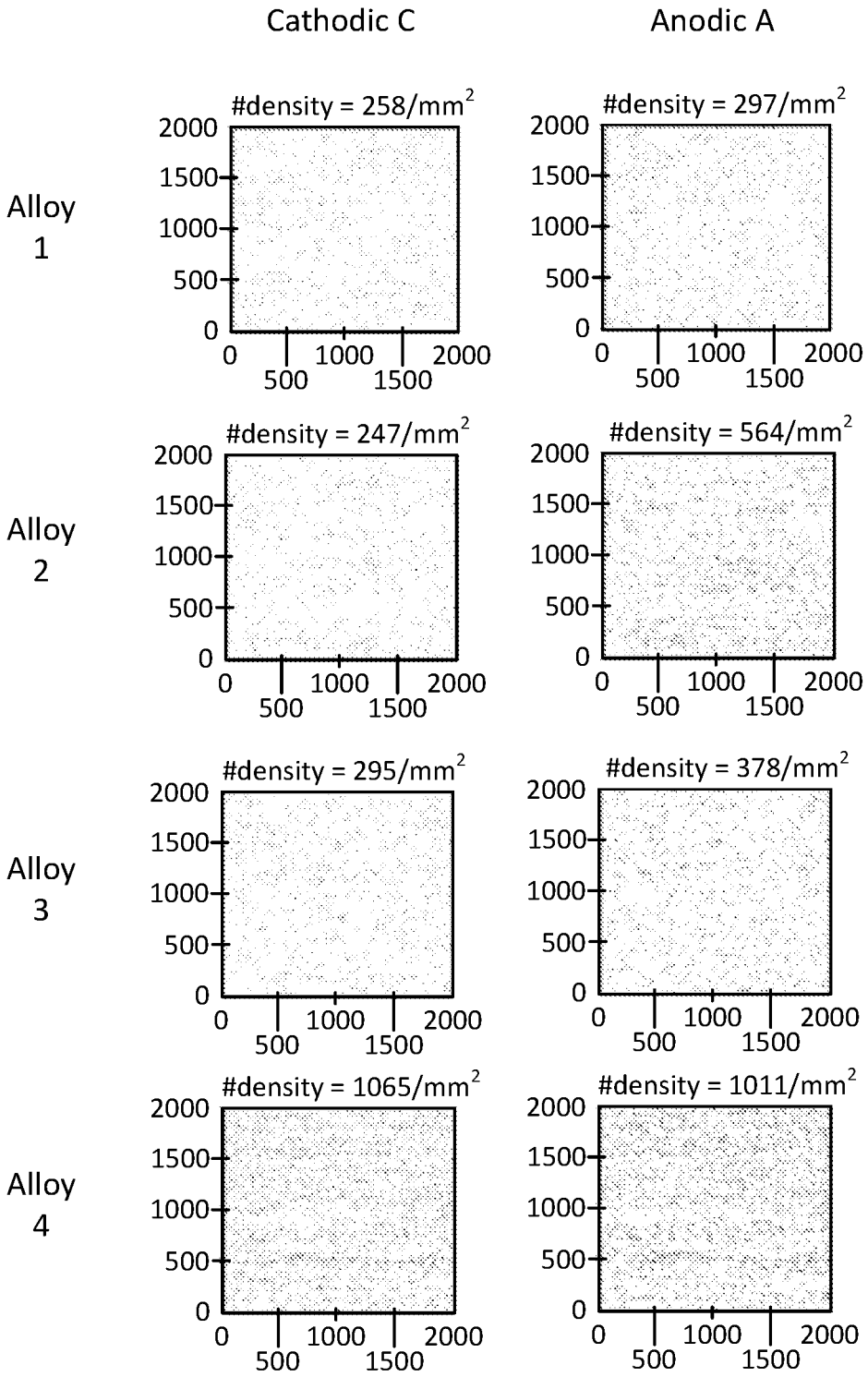

FIGS. 3A and 3B show the spatial distribution map of four main intermetallic particles in the experimental Alloys 1-4. The map shows clear variation in dominant phase type, number density, and distribution linearity of the four main intermetallic particles for each alloy. The three main cathodic intermetallic particles have similar cathodic potential, but were separated because each of them has a different reactivity resulting from the characteristic electrochemical potential as shown in Table 1. Sheets prepared from alloys 3 and 4 have lower densities of cathodic particle A as compared to sheets prepared from alloys 1 and 2.

Figure 4:
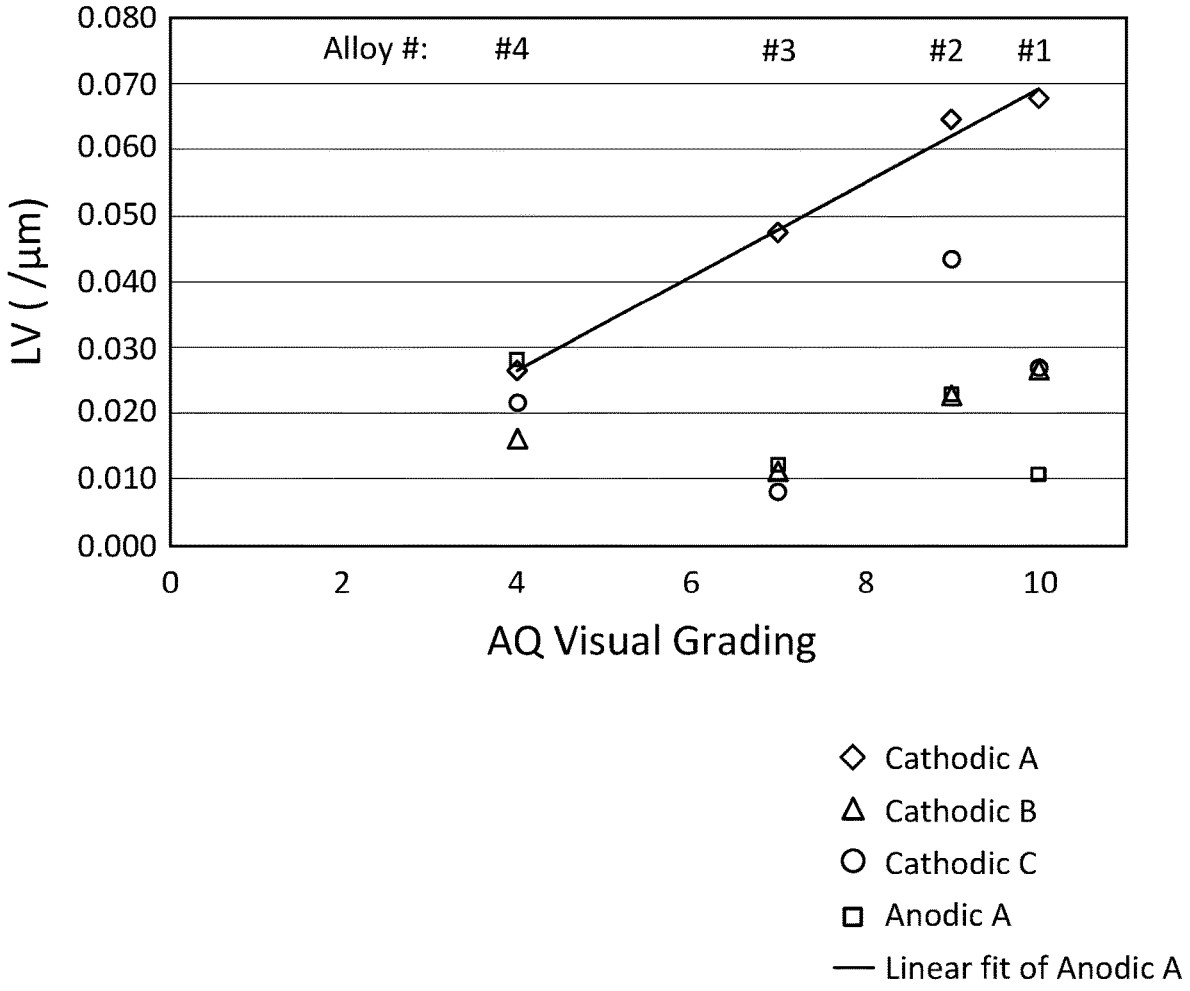
FIG. 4 shows calculated linearity values as a function of visual AQ grades of Alloys 1-4 of the disclosure.

The anodized quality of each sheet was analyzed by AQ visual grading. Calculated linearity values are shown in FIG. 4. Alloy 4 had the best AQ visual grade of 4, while Alloy 3 had an AQ visual grade of 7, Alloy 2 had an AQ visual grade of 9, and Alloy 1 had an AQ visual grade of 10. Alloy 4, which had the lowest LV of cathodic particles, had the best AQ visual grade. Also, the AQ visual grade was proportional to the LV of cathodic particle A, which has the highest oxidation potential difference from the matrix (i.e., particle A is much more resistant to dissolution than the matrix). The AQ visual grade of these alloys was not determined by the absolute number density of particles; the composition of the cathodic particles had the most effect on AQ visual grade. For example, Alloy 2 showed a better AQ visual grade than alloy 1 in spite of the higher number density of cathodic B particles. The number density of the most dominant phase was less in Alloy 1 but the reactivity of the cathodic A particles was more detrimental, and consequently Alloy 1 had a lower AQ visual grade. Thus, the AQ visual grade can be improved by changing the alloy to minimize the formation of cathodic A particles. Cathodic reactivity, number density, and linearity of the main intermetallic particles are the most dominant factors influencing the final anodized quality of the alloys.

All patents, publications and abstracts cited above are incorporated herein by reference in their entirety. Various examples have been described in fulfillment of the various objectives discussed herein. It should be recognized that these examples are merely illustrative of the principles of the invention. Numerous modifications and adaptations thereof will be readily apparent to those skilled in the art without departing from the spirit and scope of the present invention as defined in the following claims.

What is claimed is:

1. An aluminum alloy, comprising 0.10-0.30 wt. % Fe, 0.10-0.30 wt. % Si, 0-0.25 wt. % Cr, 2.0-3.0 wt. % Mg, 0.05-0.10 wt. % Mn, 0.02-0.06 wt. % Cu, unavoidable impurities up to 0.05 wt. % for each impurity, up to 0.15 wt. % for total impurities, and the balance aluminum, wherein the aluminum alloy comprises Si and Fe in a Si:Fe ratio of from 0.67:1 to 2.5:1.

2. The aluminum alloy of claim 1, comprising 0.15-0.24 wt. % Fe and 0-0.20 wt. % Cr.

3. The aluminum alloy of claim 1, comprising 0.15 wt. % Fe, 0.30 wt. % Si, 2.4 wt. % Mg, 0.07 wt. % Mn, and 0.04 wt. % Cu.

4. The aluminum alloy of claim 1, wherein the ratio of Si:Fe ratio is from 0.67:1 to 2.0:1.

5. The aluminum alloy of claim 1, comprising from about 1% to about 90% recycled content.

6. A sheet comprising the aluminum alloy of claim 1.

7. The sheet of claim 6, wherein the sheet has a cathodic particle density of no more than 2000 particles per square millimeter.

8. The sheet of claim 7, wherein the sheet has a cathodic particle density of no more than 120 particles per square millimeter.

9. The sheet of claim 6, wherein the sheet is an anodized sheet.

10. The sheet of claim 9, wherein the anodized sheet has a density of etch pits of less than 2000 pits per square millimeter.

11. The sheet of claim 9, wherein the anodized sheet is free of etch pits having a measurement in any dimension of greater than or equal to 5 μm.

12. An article comprising the aluminum alloy of claim 1, wherein the article is a consumer electronic product part, an automobile body part, an architectural part, or a lithographic part.

13. A method of preparing an aluminum sheet, comprising:

casting an aluminum alloy to form an ingot;

homogenizing the ingot;

hot rolling the ingot to produce a hot rolled intermediate product;

cold rolling the hot rolled intermediate product to produce a cold rolled intermediate product;

interannealing the cold rolled intermediate product to produce an interannealed product;

cold rolling the interannealed product to produce a cold rolled sheet; and annealing the cold rolled sheet to form an annealed sheet, wherein the aluminum alloy comprises 0.10-0.30 wt. % Fe, 0.10-0.30 wt. % Si, 0-0.25 wt. % Cr, 2.0-3.0 wt. % Mg, 0.05-0.10 wt. % Mn, 0.02-0.06 wt. % Cu, unavoidable impurities up to 0.05 wt. % for each impurity, up to 0.15 wt. % for total impurities, and the balance aluminum, and wherein the aluminum alloy comprises Si and Fe in a ratio of Si:Fe from 0.2:1 to 2.5:1.

* * * * *